US007240851B2

(12) United States Patent
Walsh, Jr.

(10) Patent No.: US 7,240,851 B2
(45) Date of Patent: Jul. 10, 2007

(54) THERMOSTAT FAN AND BOILER TIMER

(76) Inventor: John Maurice Walsh, Jr., 6125 Bear Claw La., Bozeman, MT (US) 59715

( * ) Notice: Subject to any disclaimer, the term of this patent is extended or adjusted under 35 U.S.C. 154(b) by 763 days.

(21) Appl. No.: 10/731,561

(22) Filed: Dec. 9, 2003

(65) Prior Publication Data

US 2005/0121531 A1 Jun. 9, 2005

(51) Int. Cl.
*G05D 23/19* (2006.01)

(52) U.S. Cl. ..... 236/46 C; 236/46 E; 236/15 BG; 236/94

(58) Field of Classification Search ..... 236/46 R, 236/46 C, 46 E, 49.3, 94, 15 BR, 15 BG
See application file for complete search history.

(56) References Cited

U.S. PATENT DOCUMENTS 3,929,284 A * 12/1975 Prewarski et al. ..... 236/46 R
4,321,458 A * 3/1982 Comber ..... 219/511
4,433,718 A * 2/1984 Bresin ..... 165/238
4,838,482 A 6/1989 Vogelzang
4,842,044 A 6/1989 Flanders et al.
5,142,880 A 9/1992 Bellis
5,547,017 A 8/1996 Rudd
5,582,233 A 12/1996 Noto
5,627,417 A * 5/1997 Clarke ..... 307/141
6,318,639 B1 11/2001 Toth
6,572,338 B2 6/2003 Janisse

* cited by examiner

*Primary Examiner*—Marc Norman
(74) *Attorney, Agent, or Firm*—Antoinette M. Tease

(57) ABSTRACT

A programmable timer circuit that can be connected directly to the fan switch of any thermostat with a forced air heating and/or cooling system that includes a blower fan for circulating air throughout the home. A programmable timer circuit that can be connected directly to any thermostat used in a hot-water heated home with a boiler and pump for circulating hot water through the heating system. The timer can be installed with no modifications to the existing wiring and has interchangeable leads to make installation quick and easy. The present invention increases the efficiency of the heating/cooling system, and in homes with auxiliary heat sources, circulates the warm air throughout the home to increase comfort levels. The present invention is programmable with a single button. A method of circulating hot air and/or hot water throughout a home using the timer device of the present invention.

19 Claims, 5 Drawing Sheets

Figure 4
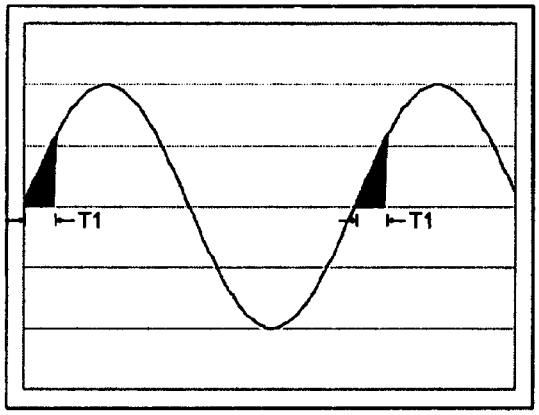
Figure 4A
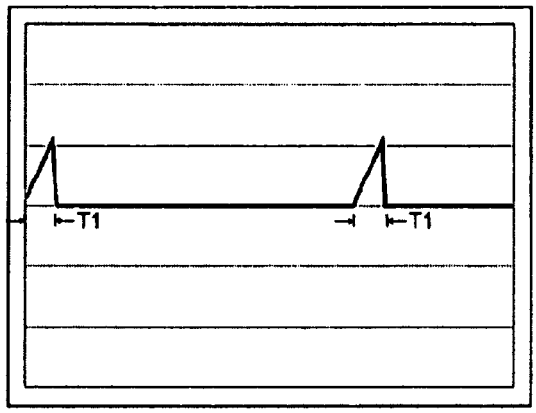
Figure 4B
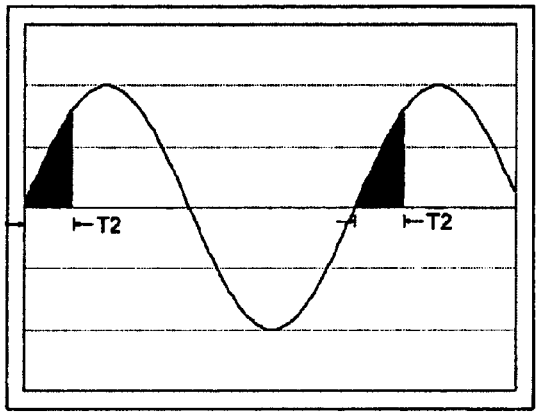
Figure 4C
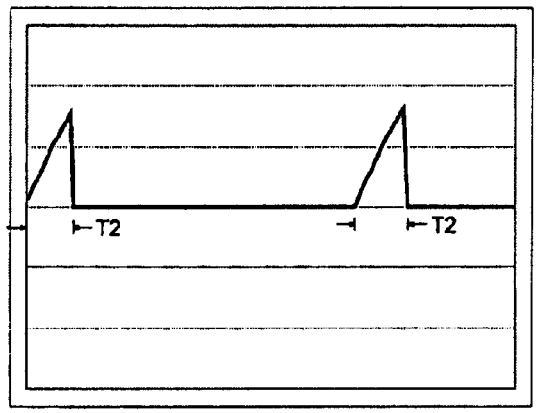
Figure 4D

THERMOSTAT FAN AND BOILER TIMER

CROSS-REFERENCE TO RELATED APPLICATION

This application is an original provisional application. It does not claim priority back to any previously filed patent application.

BACKGROUND OF THE INVENTION

1. Field of the Invention

The present invention relates to a programmable timer circuit that can be connected directly to the fan switch of any thermostat with a forced air heating and/or cooling system that includes a blower fan for circulating air throughout the home. The present invention also relates to a programmable timer circuit that can be connected directly to any thermostat used in a hot-water heated home with a boiler and pump for circulating hot water through the heating system.

2. Description of the Related Art

In homes that use an auxiliary heat source such as a wood, gas or pellet stove or a fireplace, the air in the room in which the heat source is located can become quite warm while the temperature in the rest of the home is exceedingly cool. This temperature differential can be uncomfortable to the homeowner. In the case of a home with hot-water-based heat, including radiant and/or baseboard heat, and an auxiliary heat source, the thermostat can report that the main part of the home is sufficiently warm and never call for hot water to circulate through the system, even though other parts of the home are quite cool. This circumstance can cause pipes associated with the heating system to freeze and burst because the water in them is never circulated. The present invention solves both of these problems by periodically circulating hot air or hot water, depending upon the home's heating system, throughout the home.

Mobile home owners experience similar problems. The pipes for mobile homes run underneath the home and receive heat from the furnace. If the mobile home has an auxiliary heat source, the thermostat never calls for heat from the furnace. In that event, the water pipes can freeze and burst because they are not receiving warm air from the furnace. The present invention periodically circulates the air from inside the mobile home to the area underneath the home, thereby preventing the pipes from freezing.

There are a number of patented inventions that relate generally to furnace or air conditioning control systems, but none that provides the unique features and ease of use of the present invention. For example, U.S. Pat. No. 4,838,482 (Vogelzang, 1989) discloses an air temperature conditioning system comprising a thermostat, a remotely located air temperature conditioning apparatus, a circuit means of connecting the thermostat to the air temperature conditioning apparatus, a fan connected to the conditioning apparatus, and a cycling means that is connected to the fan and that is controlled by a switch on the thermostat. The patent also provides an improvement in a space temperature control system wherein a remote temperature conditioning apparatus is controlled by a manual switch on the thermostat, the fan operates independently of the temperature conditioning apparatus, and a circuit means is connected to the manual switch to allow the fan to operate even when the temperature conditioning apparatus is not operating. Unlike the present invention, the invention covered by the Vogelzang patent cannot be retrofitted to an existing thermostat, and it requires wiring modifications that the present invention does not.

U.S. Pat. No. 4,842,044 (Flanders et al., 1989) provides a heating and cooling control system that works by energizing a fan or other fluid circulating device to circulate fluid and effect thermal transfer of energy from the fluid to the spaces being heated and by deenergizing the circulating means at a selected time interval after deenergization of the heating and control system. The patent also claims a heating control system comprising a switching means to effect energization of the fluid circulating means, a switching control means that is energizable in response to operation of the control circuit, and an additional circuit means that energizes the switching control means a selected time interval after deenergization of the heating system. The invention covered by this patent is intended to increase the time the fan is turned on after a heating cycle to improve energy efficiency. It is distinguishable from the present invention because it does not periodically circulate the blower, and it also requires the breaking of the fan circuitry. It also draws power continuously from the gas solenoid through a 680 ohm resistor, and this method has proven to be problematic in practice. The invention cannot be used to keep pipes from freezing in a boiler system, whereas the present invention can.

U.S. Pat. No. 5,142,880 (Bellis, 1992) discloses a solid state control circuit for use in connection with existing low-voltage thermostat terminals of a central, forced-air, air conditioning system having a compressor and an indoor blower and gas-fired or electrical heating elements. The invention relates generally to systems for increasing the efficiency of air conditioning units by continuing the blower running time after the compressor is turned off. Specifically, the patent claims an air conditioning control unit comprising a low voltage room thermostat fan terminal, a low voltage compressor relay terminal, a timing circuit means, a sensitive gate triac, and a power triac. The patent also claims a method for controlling the on-off time of an indoor fan that is controlled by and associated with an indoor thermostat for a room air conditioning system. This invention is distinguishable from the present invention because it does not cycle the fan but only lengthens the duration after a heat cycle. In addition, this invention, like the Flanders invention, has to be inserted into the existing circuit and thus can cause problems with the heating and cooling system if it fails.

The invention described in U.S. Pat. No. 5,547,017 (Rudd, 1996) is a system for controlling the operation of the circulating fan of a closed central air conditioning (CAC) system. The system periodically activates and deactivates only the circulating fan after a preselected delay time from the normal running of the cooling and heating modes of the CAC system, and the cooling and heating modes of the CAC system operate independently of the fan recycling control. This invention differs from the present invention because it requires connection to the air circulation system, whereas the present invention only requires connection to the thermostat. Furthermore, the timer function of the Rudd invention is not user programmable, but the timer of the present invention is.

U.S. Pat. No. 5,582,233 (Noto, 1996) relates to a timer circuit and power outlet control circuit for augmenting control and regulating operation of the blower fan in a forced air heating and cooling system. The only independent claim covers an improvement to existing technology comprising coupling a timer device into a forced air heating and cooling system and programming the timer device to delay cessation of the blower fan operation and to maintain the blower fan in operation for a limited finite time period after the cooler or heater ceases operation. Unlike the present invention, this invention is not user programmable, and it has no user interface. It requires insertion of the invention into the circuit by re-routing the wire that normally connects to the fan switch. It requires a power source and, therefore, cannot mount directly to the thermostat. Another difference between this invention and the present invention is that the present invention entails only two wires, and the wires can be connected on either side of the fan switch (in other words, each terminal on the unit is interchangeable). With the Noto invention, the wires need to be connected in a certain way to certain terminals.

In U.S. Pat. No. 6,318,639 (Toth, 2001), the inventor describes an electronic programmable thermostat with different modes of fan operations, including an automatic mode, a time mode, and a continuous mode. In the automatic mode, the air-circulating fan is operated based on temperature-related demands of the climate control system. In the time mode, the fan is operated based on the time of day. In the continuous mode, the fan is operated continuously. The invention is an improvement comprising a user-selectable temporary fan-on mode of operating the air-circulating fan in which the air-circulating fan is operated only once for a pre-selected period of time. Once the fan runs for a predetermined amount of time, operation of the fan returns to being controlled by a regular thermostat. Whereas the present invention is an addition to an existing thermostat, the Toth invention is a thermostat device. The device provides a temporary period of operation, not periodic cycling as with the present invention.

Finally, U.S. Pat. No. 6,572,338 provides a modular timer for an air circulator that energizes an air circulator motor for a predetermined amount of time. A selector switch controls the timer setting of the timer such that the time period corresponds to at least one time period of a work shift. This patent relates to a timer that attaches to an external fan and is not connected to a thermostat as part of the heating/cooling system. The present invention attaches to the thermostat and becomes part of the heating/cooling system.

The main objects of the present invention are:

(1) to provide a thermostat or boiler timer device that does not require any special power connection;

(2) to design the device such that each terminal on the unit is interchangeable for purposes of connecting the device to the fan or thermostat switch;

(3) to eliminate the necessity of any wiring modifications to accommodate the device; and (4) to restart the timing cycle automatically when the thermostat calls for heat or cooling on its own.

BRIEF SUMMARY OF THE INVENTION

The present invention covers a thermostat fan and boiler timer that comprises a microprocessor, an AC/DC converter, a zero crossing detector, a switching means, and a user interface, and that connects directly to an existing thermostat without the need for rewiring. The invention also encompasses a unique and novel way of deriving power for a thermostat microprocessor that does not rely on an external power source. The timer of the present invention has interchangeable leads that can be connected on either side of the fan switch or thermostat contact closure terminals in a boiler-based system, and a user can program the duration and interval of fan or boiler cycles, as well as the variable timing. In the preferred embodiment, all programming is done with a single button.

The timer causes periodic cycling of a heating system fan/blower in buildings that have forced air heating/cooling systems, and it causes periodic cycling of a boiler in structures that have hot water heating systems. The user interface can be any form that fits the function, including, but not limited to, an LCD display and keypad or two LEDs and a switch. The switching means can be any device that serves the requisite function; in the preferred embodiment, it is a triac. If the switching means is an electro-mechanical switch, then the invention further comprises a battery to power the microprocessor when the switch is closed.

The present invention includes a method of circulating heated air throughout a building or structure and a method of circulating hot water throughout a heating system using the thermostat fan and boiler timer of the present invention.

BRIEF DESCRIPTION OF THE DRAWINGS

FIG. 4 is a series of four graphs that illustrate the variable timing associated with powering the present invention.

REFERENCE NUMBERS

Figure 1:
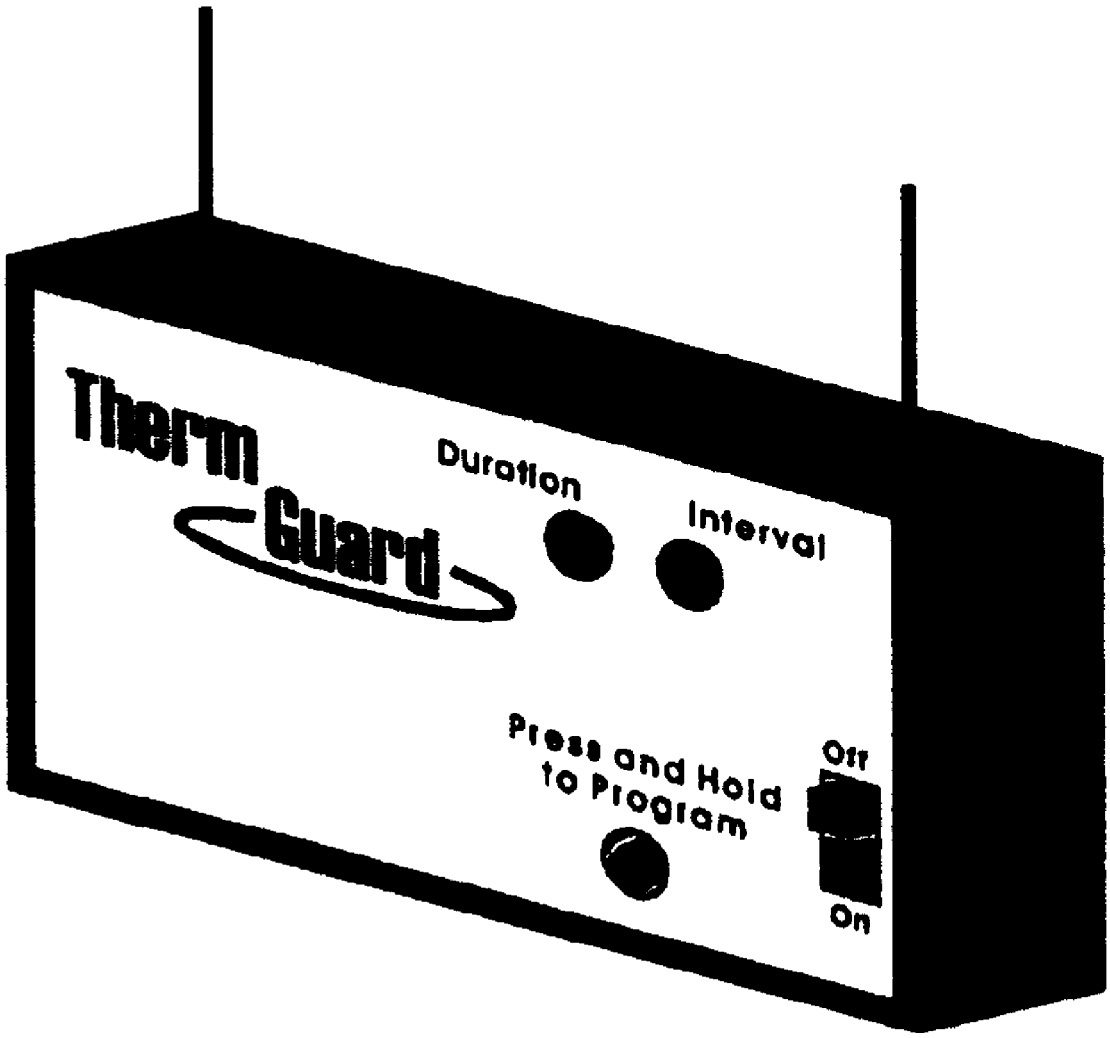
FIG. 1 is a pictorial illustration of the preferred embodiment of the invention.

1 Existing household thermostat
2 Furnace/heat producing control circuitry
3 Air conditioning unit/air conditioning control circuitry
4 Fan contact terminal
5 Fan/blower relay or Zone valve/Zone relay
6 System fan/blower or Boiler
7 Air conditioning contact terminal
8 Heater contact terminal
9 Hot contact terminal
10 System 24 VAC transformer
11 Thermostat fan and boiler timer
11A Thermostat fan and boiler timer (first embodiment)
11B Thermostat fan and boiler timer (second embodiment)
12 First lead
13 Second lead
14 Microprocessor
15 AC/DC converter
16 Zero crossing detector
17 Switching device
18 User interface
19 Optional battery
20-49 Flow diagram blocks

DETAILED DESCRIPTION OF INVENTION

FIG. 1 is a pictorial illustration of the preferred embodiment of the invention. The present invention connects directly to an existing thermostat through the use of only two wires and without the need for rewiring any of the thermostat connections. It can be mounted on the wall near the thermostat or located anywhere else in the house, as long as it can be connected to the thermostat wires.

Figure 2:
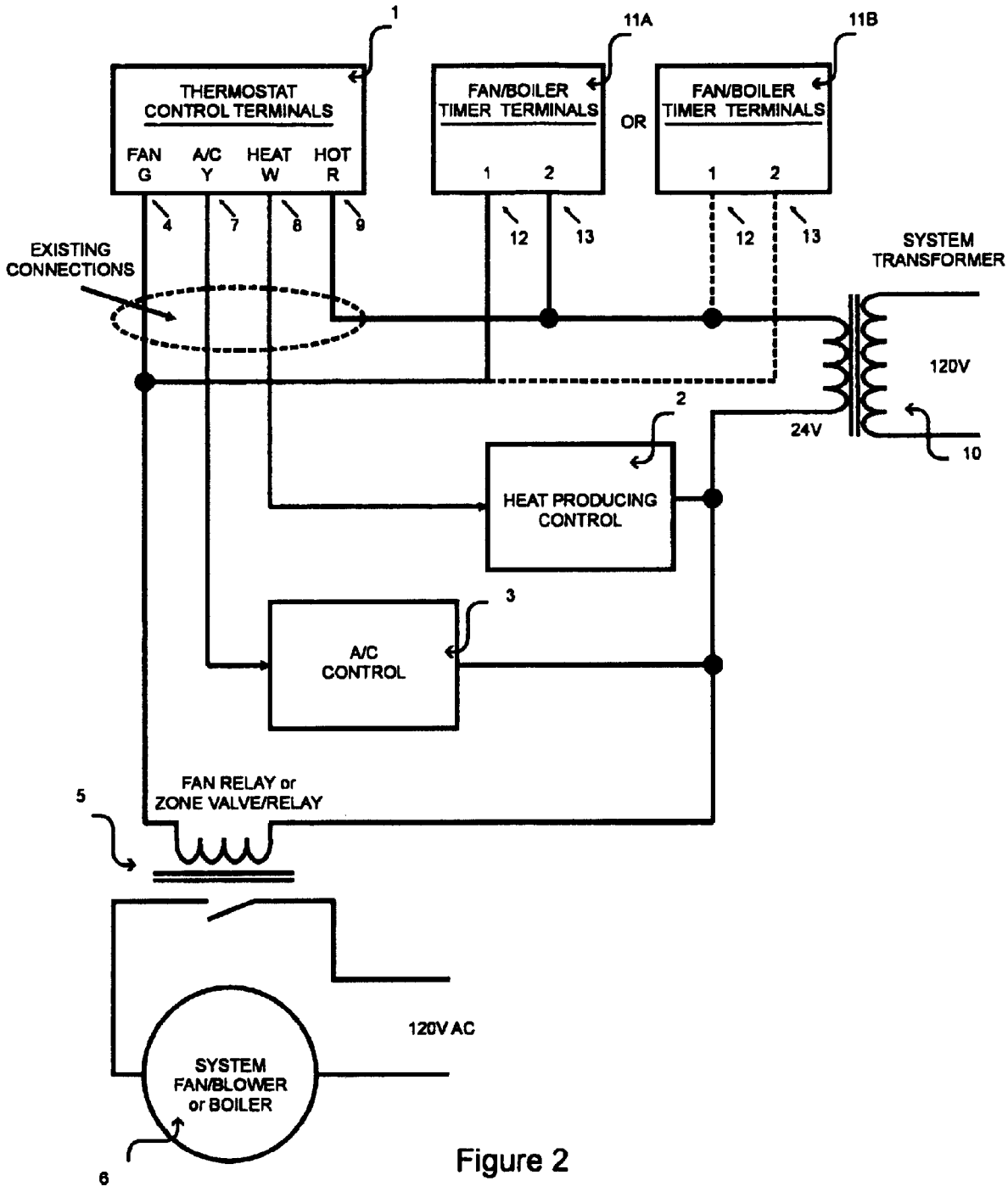
FIG. 2 illustrates, in block diagram form, the configuration of the present invention in relation to an existing household thermostat.

FIG. 2 illustrates, in block diagram form, the configuration of the present invention in relation to an existing household thermostat 1. This unit is typically connected as shown when the home has a furnace 2 and air conditioning unit 3. The fan contact terminal 4 connects the thermostat 1 to the fan/blower relay 5. When actuated, the fan relay 5 connects the system fan/blower 6 to the 120 VAC. The air conditioning contact terminal 7 connects the thermostat 4 to the air conditioning control circuitry 3. The heater contact terminal 8 connects the thermostat to the heat producing control circuitry 2. The hot terminal 9 connects the thermostat to the hot side of the 24 volt AC transformer. Households with heat only and homes with boilers will not have the connection to the air conditioning unit 3. The fan/blower relay 5 is connected to the existing thermostat, and no modifications to this connection are required. The majority of the prior art requires rewiring of the thermostat to include a new device in this wiring path. FIG. 2 also shows the system 24 VAC transformer 10.

In FIG. 2, the present invention is shown in two different embodiments 11A, 11B to demonstrate the interchangeability of the two leads. In the first embodiment 11A, the first lead 12 is connected to the fan/blower relay 5, and the second lead 13 is connected to the lead of the hot contact terminal 9. In the second embodiment 11B, the first lead 12 is connected to the lead of the hot contact terminal 9, and the second lead 13 is connected to the fan/blower relay 5. Only one timer device is necessary to operate the system. Regardless of which way the device leads are connected to the thermostat 1, the device of the present invention connects in parallel with the existing fan switch. No additional power connections are required, unlike prior art, which requires either a dedicated connection to the transformer or another relay. The present invention draws power through the fan/blower relay 5. This lack of external power is new and innovative as compared to prior art.

In a home with hot water heat, the fan/blower relay 5 would be a zone relay or zone valve, which would call for hot water to be distributed into the zone with the present invention connected to the thermostat 1. In this way, hot water can be periodically circulated through the pipes to keep them from freezing when the thermostat is turned off or an auxiliary heat source causes the thermostat not to cycle.

Figure 3:
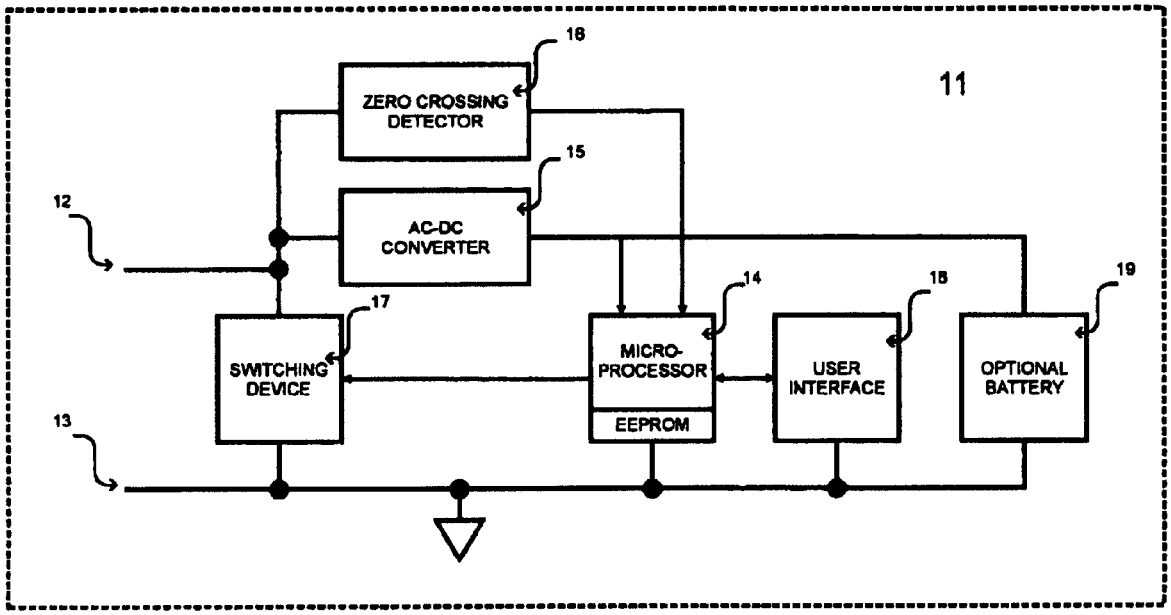
FIG. 3 illustrates, in block diagram format, the components of the present invention.

FIG. 3 illustrates, in block diagram format, the components of the present invention 11. A microprocessor 14 is used to control the switch, receive input and provide output to the user interface. It receives power from the AC/DC converter and also receives input from the zero crossing detector 16. The microprocessor 14 performs several major functions. In terms of timing, the microprocessor 14 keeps track of seconds and minutes by monitoring the AC line signal. Each positive zero crossing accounts for $1/60^{th}$ of a second; therefore, sixty positive crossings occur each second. The seconds are then accumulated to keep track of minutes. The negative crossings are also monitored to provide timing for the switch. In the event the switch is a triac, it must be triggered at each positive and negative zero crossing of the AC line.

The user interface 18 consists of an input device to the microprocessor 14 and visual outputs to the user that enable the programming of the timing cycles. The microprocessor 14 continuously monitors the input device to determine if there is any change to the current system operation. If a change is requested by the user, the current programming of the switch state is set to neutral (switch is turned off) and the input device is monitored to determine the user's requested action. In the preferred embodiment, the microprocessor contains an EEPROM, which allows the unit to store the user's programming instructions when there is no power applied to the unit.

The AC/DC converter 15 is used to condition the input 24 VAC signal into the DC signal necessary to operate the DC devices within the unit. The zero crossing detector 16 is used to condition the AC input to a level that will not damage the microprocessor. The microprocessor 14 generates an interrupt in both the positive going and negative going zero crossings and uses this zero crossing timing to keep track of elapsed time and also to determine when to fire the triac, which may be used as the switching device 17. The switching device 17 could be either a standard relay type device, a reed relay or some other electro-mechanical device. It could also be a solid state device such as an FET switch or a triac. Each device requires minor modifications to the baseline design, but each manifestation of the switch is covered by the present invention. The description of the preferred embodiment is based on a triac switch, but the present invention is not limited by the type of switching device.

The user interface 18 can take on many forms, including, but not limited to, an LCD display and keypad. To minimize cost, the preferred embodiment simply uses two LEDs and one switch. One LED (green) is an indicator for the time interval between operations of the fan (in fifteen minute intervals) and the other (red) is an indicator for the duration the fan is to remain on (in minutes). The switch is used to enter the program into the present invention. FIG. 4 is a detailed flow chart of the interaction between the LEDs and the switch when entering a program.

The preferred embodiment of the present invention using a triac does not require a battery. The timer device draws its power through the fan relay coil or the boiler zone valve motor/relay. In the event that an electro-mechanical switch were used, an optional battery would be added to power the microprocessor 14 when the switch is closed. The closing of an electro-mechanical switch effectively shorts out power to the timer device and, therefore, requires the use of a battery to maintain functionality.

FIG. 4 is a series of four graphs that illustrate the variable timing associated with powering the present invention. Because power is drawn through the fan/blower relay 5, when the fan/blower relay is not actuated, 24 VAC is applied to the terminals of the invention. That power is sufficient to drive the timer device of the present invention and all its components. Normally, to actuate the fan relay, the fan switch must appear closed, in other words, in FIG. 2, the fan contact terminal 4 must be shorted to the hot contact terminal 9. This situation creates a problem for anything that is trying to draw power from these terminals because they are now shorted and there is no power available.

The present invention uses an innovative way to draw power. In the preferred embodiment of the invention, using a triac as a switch, the microprocessor does not enable the triac at exactly the zero crossing of the 24 VAC signal. Instead, it delays a programmable amount of time into the positive going cycle and allows the positive going waveform to provide a small amount of charge into the AC/DC circuitry. This charge is represented by the dark areas in FIGS. 3A and 3C. The programmable delay is represented by the time differences between T1 and T2 in FIGS. 3A, 3B, 3C, and 3D. The longer the delay, the more power is passed to the AC/DC circuitry. This programmability is required to accommodate different resistances in the relays, the line length to the relay and the different characteristics of a zone valve in a boiler system. After a small charge has been accumulated, the microprocessor 14 enables the triac to pass the remainder of the power through to the relay. This occurrence is represented by FIGS. 3B and 3D. These figures show the AC waveform rising for a short period and then completely shorted out for the duration of the cycle, which passes this energy on to the relay and thus actuates it. In this way, the relay gets the majority of the AC waveform and actuates, while enough charge is stored by the AC/DC circuitry to keep the microprocessor 14 running until the next positive going cycle of the AC waveform. For purposes of this paragraph, the term "relay" means either a fan/blower relay of a forced air heating system or a zone valve/zone relay of a boiler system.

In another embodiment of the present invention, a battery 19 could be used to supply power to the microprocessor 14 when the invention is actuating the fan switch. In this situation, the entire waveform would be passed to the fan/blower relay 5. This method is less complex but increases the cost of the invention and adds an item (the battery) that requires maintenance and periodic replacement.

Figure 5:
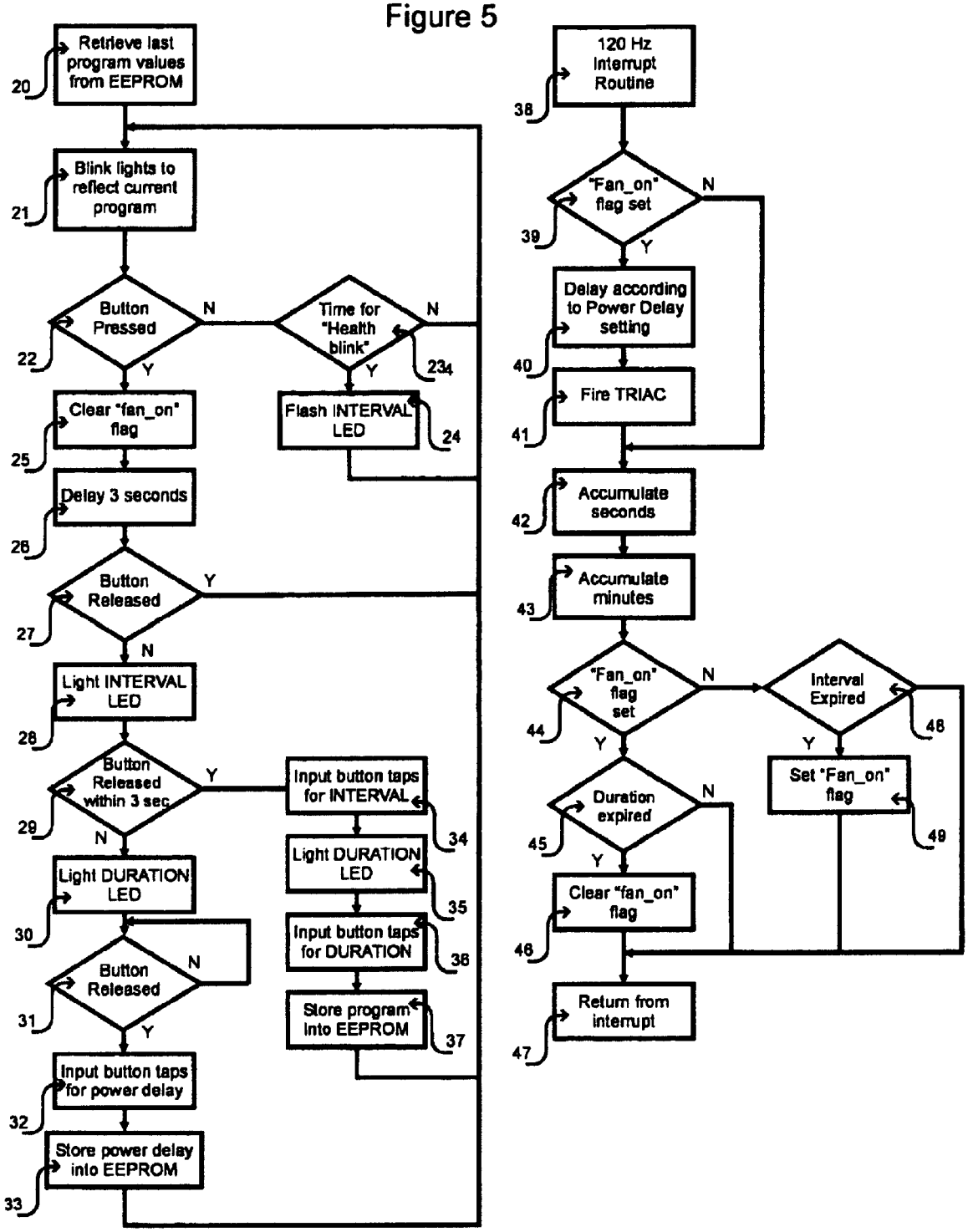
FIG. 5 illustrates, in block diagram form, the programming of the preferred embodiment of the present invention.

FIG. 5 illustrates, in block diagram format, the programming of the preferred embodiment of the present invention. The following discussion of FIG. 5 relates to the fan cycle, but the same principles would apply to a boiler cycle in a hot-water-based heating system. The main routine begins at block 20. The interrupt routine begins at block 39. Block 20 indicates that when power is first applied to the present invention, the last stored program is retrieved from the non-volatile storage (EEPROM), and the present invention is initialized to the last programmed state. Block 21 indicates that the invention will blink the LEDs to visually indicate the last programmed state. It will first blink the green LED to represent the number of fifteen-minute periods between fan cycles, in other words, the amount of time to wait between when the fan was last deactivated and the next time to reactivate the fan. This time period is also known as the "interval." Next, the red LED will blink to represent the number of minutes during which the fan will remain on for one cycle. This time period is also known as the "duration."

Decision block 22 is the decision block of the main loop. If no button is pressed, the program then looks at an internal timer to determine if it is time to indicate that the present invention is powered up and working properly. This decision is made in decision block 23. If the timer is turned on and timing properly, the green "interval" LED is quickly flashed as indicated in block 24. If decision block 22 determines that there is a button pressed, then the routine proceeds to block 25 and immediately clears the "fan_on" flag, which causes the fan to be turned off at the next interrupt. The present invention then delays for three seconds as indicated in block 26. The button is again tested as shown in decision block 27. If the button was released before the three seconds are up, then the programming loop is aborted, and the unit restarts at block 21.

If the button was held down for at least three seconds as indicated in decision block 27, it is clear that the user wishes to change the programming. The green "interval" LED is illuminated (shown in block 28), which indicates to the user that the invention is ready to accept button taps as programming input for the interval. Once the green "interval" LED is illuminated, the unit begins another three-second internal timer. If the user releases the button within three seconds of seeing the green LED illuminated, as determined in decision block 29, then the routine enters the interval and duration programming mode as shown in blocks 34 through 37.

Block 34 indicates that the user now taps the programming button from 0 to 96 times, which internally is interpreted as the number of fifteen-minute periods that the present invention will wait between fan cycles. In other words, if the user taps the button four times, the present invention will delay one hour, or four fifteen-minute periods, between cycling the fan. Block 35 indicates that after the user has tapped in the number of fifteen-minute intervals and releases the button for three seconds, the invention turns on the red "duration" LED. This is a signal to the user that the present invention is ready to accept button taps as programming input for the duration the fan is to run. Block 36 indicates that the user now taps the programming button from 0 to 24 times, which internally is interpreted as the number of one-minute periods that the present invention will run the fan. In other words, if the user taps the button five times, the present invention will delay the programmed amount of time as described above (i.e., the interval) and then turn the fan on for five minutes.

Once the interval and duration are programmed, the unit stores the new program into the non-volatile storage (EEPROM) as indicated in block 37 and then restarts from the beginning at block 21. If the user enters the programming mode and at any step does not enter any button taps for either the interval or duration, the present invention will revert to the last number of taps that was stored in the non-volatile memory (EEPROM) for the interval and/or duration.

In addition to the function described above, block 29 also determines if the button was not released within three seconds of when the green interval LED was illuminated. Continuing to depress the programming button after the green interval LED was illuminated indicates to the present invention that the user wishes to skip the interval and duration programming and proceed to program the power delay. The present invention indicates that it is ready to accept power delay programming by extinguishing the green "interval" LED and illuminating the red "duration" LED. This is indicated in block 30 and is the signal to the user that the power delay is ready to be programmed. This programmability is required to accommodate different resistances in the relays, the line length to the relay and the different characteristics of a zone valve in a boiler system.

At decision block 31, the present invention waits for the user to release the programming button. Block 32 is used to count the number of taps the user enters for the power delay. There are four pre-set power delay values, and the user taps the button once, twice, three or four times to indicate which setting would be optimal for the current configuration (either fan relay or zone valve in the case of a boiler-based system). Block 33 stores the new power delay value into the non-volatile memory (EEPROM), and the unit restarts from the start at block 21.

Block 38 indicates the beginning of an interrupt routine. This routine is entered at the rising and falling zero crossings of the 24 VAC signal. The interrupt routine first determines if the fan is scheduled to be on in decision block 39. If not, the routine merely accumulates seconds (block 42) and minutes (block 43) by counting the number of 60 Hz transitions on the 24 VAC power input line.

Decision block 44 again checks if the fan is on. If the fan is not supposed to be on, the routine examines the interval timer in block 48 to determine if the fan should be turned on. If the interval time has expired, then the "fan_on" flag gets set in block 49, and the fan will be turned on the next interrupt cycle. If the fan is supposed to be on, as determined in block 39, block 40 looks at the preprogrammed (see blocks 29-33) power delay setting to determine how long to delay into the rising edge of the 24 VAC input power cycle before firing the triac. If a battery were used in the present invention, this step would not be required.

After delaying the amount of time programmed into the power delay setting, block 41 fires the triac, and the remainder of the 24 VAC signal is passed on to the fan relay, thus energizing the relay for this 60 Hz cycle. The interrupt routine then follows the actions as described above by accumulating the seconds (block 42) and minutes (block 43). In the case where the fan is on in block 44, the duration timer is examined to determine if the duration has expired in decision block 45. If so, then the "fan_on" flag is cleared in block 46, and the fan is turned off the next interrupt cycle. If the duration has not expired or after the "fan_on" flag has been cleared in block 46, the routine returns to the main routine in block 47.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

DEFINITIONS

The term "AC/DC" means Alternating Current/Direct Current.

The term "EEPROM" means Electronically Erasable Programmable Read Only Memory.

The term "FET" means Field-Effect Transistor.

The term "Hz" means "hertz" or a unit of frequency equal to one cycle per second.

The term "LCD" means Liquid Crystal Display.

The term "LED" means Light Emitting Diode.

The term "triac" means a three-terminal semiconductor for controlling current in either direction.

The term "VAC" means Volts, Alternating Current.

I claim:

1. A thermostat fan and boiler timer comprising a microprocessor, an AC/DC converter, a zero crossing detector, a switching means, and a user interface, wherein the timer connects directly to an existing thermostat without the need for rewiring any existing thermostat connections.

2. The thermostat fan and boiler timer of claim 1, wherein the timer operates without an external power source.

3. The thermostat fan and boiler timer of claim 1, further comprising interchangeable leads that can be connected on either side of a fan switch.

4. The thermostat fan and boiler timer of claim 1, further comprising interchangeable leads that can be connected on either side of a thermostat switch terminal of a boiler system.

5. The thermostat fan and boiler timer of claim 1, wherein a user can program the duration and interval of fan cycles.

6. The thermostat fan and boiler timer of claim 1, wherein a user can program the duration and interval of boiler cycles.

7. The thermostat and boiler timer of claim 1, wherein the timer causes periodic cycling of a heating system fan/blower.

8. The thermostat and boiler timer of claim 1, wherein the timer causes periodic cycling of a boiler.

9. The thermostat and boiler timer of claim 1, wherein the user interface comprises an LCD display and keypad.

10. The thermostat boiler and timer of claim 1, wherein the user interface comprises two LEDs and one switch.

11. The thermostat fan and boiler timer of claim 1, wherein the timer can be programmed with a single button.

12. The thermostat fan and boiler timer of claim 1, wherein the timer determines both an interval between fan cycles and a duration of fan cycles, and both the interval and duration can be programmed with a single button.

13. The thermostat fan and boiler timer of claim 1, wherein the timer determines both an interval between boiler cycles and a duration of boiler cycles, and both the interval and duration can be programmed with a single button.

14. The thermostat fan and boiler timer of claim 1, wherein the timer includes three programming variables, and all three programming variables can be programmed with a single button.

15. The thermostat fan and boiler timer of claim 14, wherein the three programming variables are interval, duration and variable timing.

16. The thermostat fan and boiler timer of claim 1, wherein the switching means is a triac.

17. The thermostat fan and boiler timer of claim 1, wherein the switching means is an electro-mechanical switch, and further comprising a battery to power the microprocessor when the switch is closed.

18. A method of circulating heated air throughout a building or structure using the thermostat fan and boiler timer of claim 1.

19. A method of circulating hot water throughout a heating system using the thermostat fan and boiler timer of claim 1.

* * * * *